US006236932B1

(12) United States Patent
Fastenrath

(10) Patent No.: US 6,236,932 B1
(45) Date of Patent: May 22, 2001

(54) PROCESS FOR COMPLETING AND/OR VERIFYING DATA CONCERNING THE STATE OF A ROAD NETWORK; TRAFFIC INFORMATION CENTRE

(75) Inventor: Ulrich Fastenrath, Düsseldorf (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/331,102

(22) PCT Filed: Dec. 1, 1997

(86) PCT No.: PCT/DE97/02869

§ 371 Date: Jun. 16, 1999

§ 102(e) Date: Jun. 16, 1999

(87) PCT Pub. No.: WO98/27525

PCT Pub. Date: Jun. 25, 1998

(30) Foreign Application Priority Data

Dec. 16, 1996 (DE) ..... 196 53 689
Nov. 27, 1997 (DE) ..... 197 54 483

(51) Int. Cl.[7] ..... G06G 7/70

(52) U.S. Cl. ..... 701/117; 701/119; 701/118; 340/991; 340/425.5; 180/167

(58) Field of Search ..... 701/117, 118, 701/119, 120; 180/167; 340/425.5, 991, 992, 993

(56) References Cited

U.S. PATENT DOCUMENTS 5,289,183 * 2/1994 Hassett et al. ..... 340/905
5,696,503 * 12/1997 Nasburg ..... 340/933
5,812,069 * 9/1998 Albrecht et al. ..... 340/905
5,999,877 * 12/1999 Takahashi et al. ..... 701/117
6,092,020 * 7/2000 Fastenrath et al. ..... 701/119

* cited by examiner

*Primary Examiner*—William A. Cuchlinski, Jr.
*Assistant Examiner*—Olga Hernandez
(74) *Attorney, Agent, or Firm*—Cohen, Pontani, Lieberman & Pavane

(57) ABSTRACT

Traffic status reports and traffic forecasts of a central traffic station are optimized by a central traffic station by a process for the completion and/or verification of data concerning the status of a traffic network in a central traffic station data of the following types are used for this purpose:

measurement data measured up to the present time;

status data that are calculated for at least a point in time prior to the current time concerning the status of the traffic network at this point in time; and forecast data calculated for a time in the past and concerning a future time with respect to this time in the past.

12 Claims, 2 Drawing Sheets

PROCESS FOR COMPLETING AND/OR VERIFYING DATA CONCERNING THE STATE OF A ROAD NETWORK; TRAFFIC INFORMATION CENTRE

BACKGROUND OF THE INVENTION

1. Field of the Invention

The invention is directed to a process for the completion and/or verification of data concerning the status of a traffic network.

2. Discussion of the Prior Art

A central traffic generates traffic station reports concerning the current status or a future state of the traffic network based on measurement data (in particular average speed, quantity of vehicles, volume of traffic) measured by stationary detectors at determined positions in the traffic network and/or based on measurement data, especially vehicle speeds, measured by mobile detectors (FCD). However, the measurement data available to the central traffic station do not cover areas with respect to the traffic network; measurement data measured by mobile detectors in the motor vehicles are not available where there are no motor vehicles with mobile detectors. Measurement data measured by stationary detectors are only available where stationary detectors are located and in operation and have just sent measurement data, wherein the transmission of measurement data, for example, in the case of detectors operated by solar energy, can be carried out only in relatively large time intervals. Because of incompleteness with respect to area coverage, verification with respect to errors is made more difficult and the quality of the prepared traffic reports is not optimum.

SUMMARY OF THE INVENTION

It is the object of the present invention to optimize the generation of a traffic report concerning a current status or a future state of the traffic network in a simple, economical and efficient manner.

Traffic status analysis and/or forecast in a central traffic station is optimized through the use, according to the invention, of three different types of data for completing and/or verifying. For this purpose, a repeated feedback of data is carried out for completion and/or verification of data. The type of feedback depends on the type of data that are fed back.

A cyclic feedback of progress lines or profiles, that is, compressed historic data, are advisable above all; a profile is, for example, the traffic volume curve on Mondays.

A direct feedback is important above all in interpolating or taking into account movements of vehicles in the system, wherein this model component can check after every time increment whether or not an assumption about a traffic state downstream in traffic made on the basis of sensor data is consistent with data coming in from that location.

For the purpose of feeding back status data derived from measurement data relating to the past and/or forecast data prepared in the past for completion and/or verification of measurement data, derived quantities and quantities relating to measurement data can be considered in relation to one another when the status data or forecast data concern other (especially derived) quantities of the traffic network. In addition to a completion and verification of measurement data, it is also possible, in particular, to complete and/or verify status data concerning the current status of a traffic network. In so doing, a feedback of status data relating to times in the past and forecast data calculated from times in the past can be carried out for purposes of completion and/or verification of status data concerning the current status indirectly by completing and/or verifying measurement data and/or by passing on, at least in part, status data which are fed back in a base component with measurement data and/or forecast data in a model component provided for calculation of status data. Forecasts prepared in a forecast component of the central traffic station concerning the status of a traffic network for a future time are also optimized in this way when they are carried out based on completed and/or verified measurement data and/or based on completed and/or verified status data.

For this purpose, the current status of a traffic network can be calculated from measurement data measured up to the current time and from one or more traffic states of the traffic network at times in the past. In this connection, different process components can be used alternately or in conjunction for verification and/or for further completion by using any measurement data that may be completed or verified. A flow model and/or fuzzy logic and/or interference behavior detection and/or a domain model divisional method are/is particularly advisable for determining the current status of the traffic network. Previous states and/or status data, which may possibly be completed or verified, concerning the current status and/or previously measured measurement data (which can be passed on from the model component to the forecast component similar to a multiplexer) that are completed or verified in addition or instead can be used to prepare a forecast concerning a future point in time.

For completion and/or verification, statistical data of a historic database relating to states and/or measurement data of the traffic network at times in the past are/is advisably used. For this purpose, the historic database which can be assigned to the base component in a central traffic station is constantly updated in the central traffic station with measurement data and/or status data. The historic database can contain, in particular, profile data concerning time curves of measurement data and/or states for the completion and/or verification. Profile data of this type can contain, in particular, time curves of measurement data and/or states over the course of a weekday; variations over the course of a year can be stored, if required.

A program for implementing the process according to the invention can be realized in a central traffic station.

Further features and advantages of the invention are indicated in the following description of an embodiment with reference to the drawings.

DETAILED DESCRIPTION OF THE PREFERRED EMBODIMENTS

Figure 1:
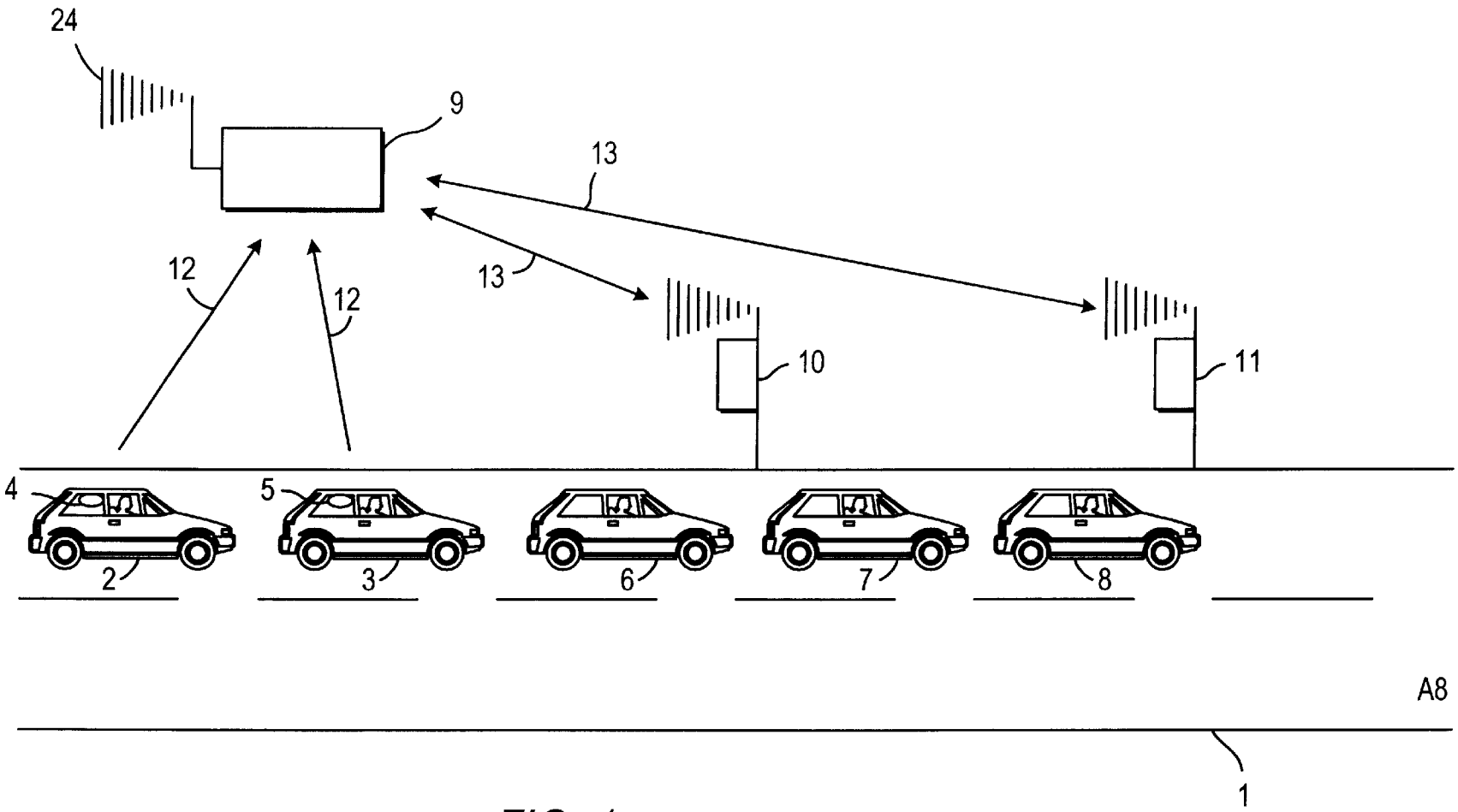
FIG. 1 shows schematically vehicles driving on a road with mobile detectors, stationary detectors at the road, and a central traffic station.

In FIG. 1, vehicles 2, 3 with detectors 4, 5 and vehicles 6, 7, 8 without detectors drive on a road 1 (for example, highway A8). The detectors 4, 5 in the vehicles determine, for example, their vehicle positions by GPS and their speeds, etc. and report this as measurement data 12 to the central traffic station 9. Further, stationary detectors 10, 11 are located at fixed positions in the traffic network; these detectors 10, 11 measure, for example, the number of vehicles passing them, their speeds, etc. and report, e.g., average vehicle speeds, speed variances, the quantity of vehicles per unit of time, etc. to the central station 9 as measurement data 13. Based on the measurement data 12, 13, the central traffic station 9 prepares traffic reports concerning the current status of a traffic network such as current traffic backup reports, current travel time reports and traffic forecasts for times in the future, for example, anticipated traffic backups, etc. and sends (24) traffic status reports and traffic forecast reports via radio, wireless, mobile radio, etc. to subscribers.

However, measurement data 12, 13 do not cover all areas with respect to the traffic network because measurement data from mobile detectors in vehicles 2, 3 are only transmitted at precisely those vehicle locations and because measurement data 13 from stationary detectors 10, 11 can only be determined where the detectors are located, are in operation and are engaged in transmission.

Figure 2:
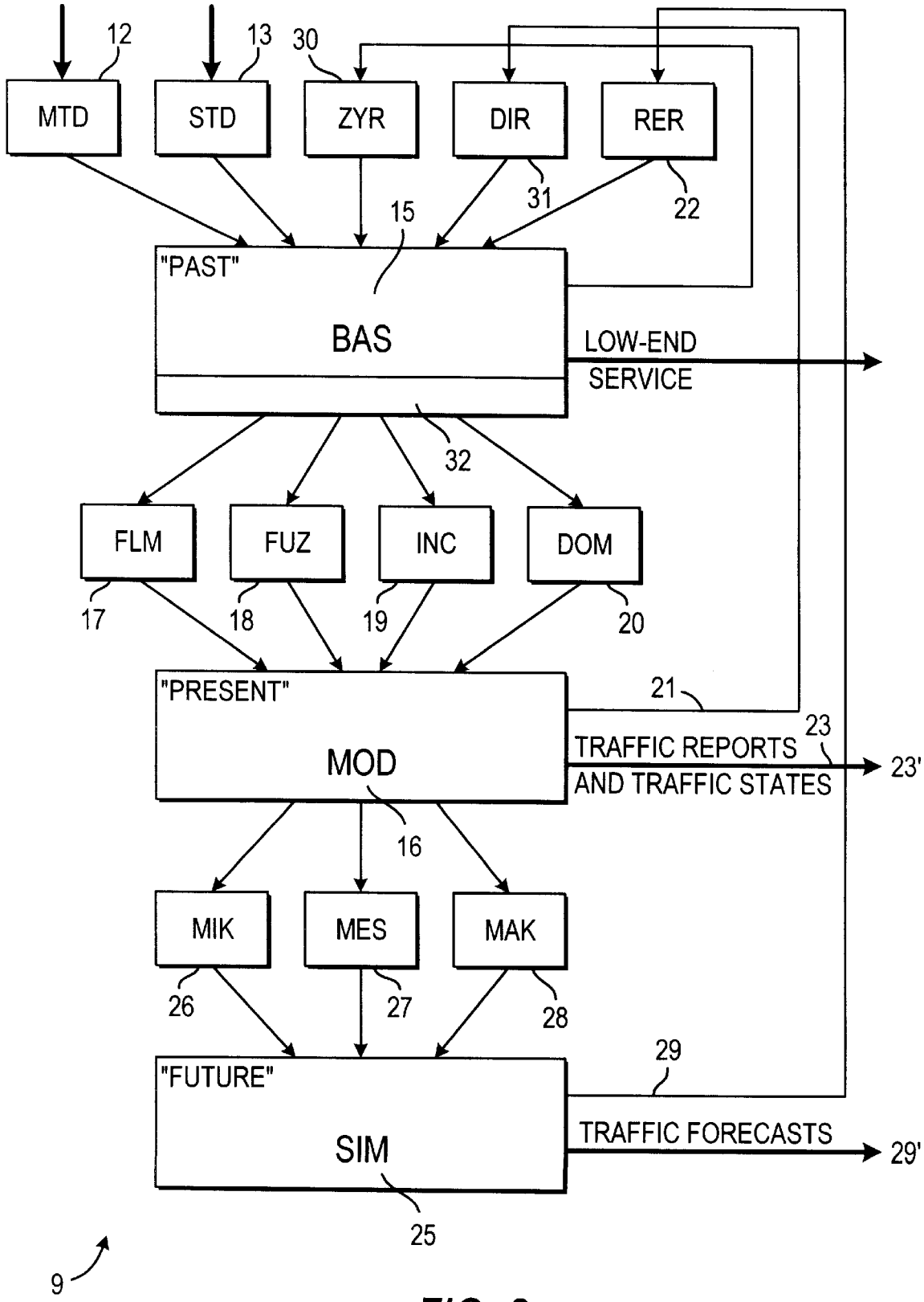
FIG. 2 shows a rough block diagram of data coming into a central traffic station which are fed back, further processed and read out, and components of the central traffic station.

FIG. 2 illustrates the improvement, according to the invention, of traffic reports for current traffic status and/or of traffic forecasts through repeated feedback of data of different types in the central traffic station 9 shown in FIG. 2.

The central traffic station 9 receives continuous measurement data 12 (shown by the data container MTD) and measurement data 13 (shown by data container STD) from stationary detectors at a plurality of locations in the traffic network as input values.

The measurement data 12, 13 are continuously stored in the program and database components BAS 15 of the central traffic station 9 in a historic database with a time reference of the measurement data 12,13. Accordingly, BAS contains measurement data from preceding points in time until shortly before the current time. Further, BAS 15 can pass on measurement data 12,13 that have just been measured and/or measurement data from the historic database 32 in 15 relating to times in the past as a multiplexer or database interface to a model component 16 of the central station 9 and/or to components 17 to 20 preceding the latter for calculation of traffic states. The model component 16 calculates (17 to 20) current traffic states of the traffic network at different locations of the traffic network. Status data concerning states at previous times can be stored in the model component 16 or in the base component 15. Status data 21 concerning the current traffic status can be fed back 30 from the model component into the base component 15 or from the model component, via the base component 15, into model component 16 (immediately or with a time delay via a historic database) for completion and/or verification of status data and/or measurement data. The feedback of measurement data is shown in the present case as cyclic feedback 30 to the base component 15 for completion of measurement data. Further, in the model component 16 of the central station 9, traffic reports 23 for the current traffic status of the traffic network can be sent to one or more locations (FIG. 1/24). Further, particularly the status data of at least the current time and possibly also for preceding times and, if required, measurement data (which are given over from the base component) sent from a historic data base or measured are used to generate (26, 27, 28) a traffic forecast for the traffic network at least for a time in the future in the forecast component 25 of the central traffic station 9 and to display as traffic forecast data 29. Further, forecast data 29 about a time in the past prepared for a future time later than this past point in time are fed back 22 by the forecast component 25 for completion and/or verification of data. Further, it is possible to pass on the traffic forecasts which were prepared at times in the past and which can therefore concern the current time, for example, from the base component 15 to the model component 16. Accordingly, forecast data 29 can be used for completion and/or verification of measurement data and/or of status data for the current time. Forecast data 29 which are fed back or will be fed back can be stored in the forecast component 25 in an intermediate storage, not shown, or in the base component 15 in a historic database.

When status data 21 are multiplexed via the base component 15 by means of a buffer, not shown, or fed back directly in the model component 16, this can be referred to as direct feedback 31.

The feedback of forecast data and status data enables a completion and/or verification of measurement data and/or status data which optimizes both traffic reports 23 and traffic forecasts 29.

The generation of traffic forecasts 29 based on status data 21 for current times and possibly times in the past in the model component 16 and possibly, in addition, the generation of measurement data for current times or times in the past can be carried out by different methods. In particular, microscopic methods 26, mesoscopic methods 27 or macroscopic methods 28 are suitable for preparing traffic forecasts. If necessary, several methods 26 to 28 can also run conjointly and the obtained forecast data are completed and/or verified.

What is claimed is:

1. A central traffic station, comprising:

a storage;

a program stored in the storage for carrying out process for completing and verifying data concerning a status of a traffic network in the central traffic station, the process including measuring measurement data about vehicles up to a present time, calculating status data for at least a point in time prior to the present time concerning the status of the traffic network at this point in time, calculating forecast data for a past time in the and concerning a future time with respect to the past time, using the measured and calculated data to complete and verify the traffic network status data;

a storage for the data;

a processor for running the program; and a communication device for entering measurement data.

2. A central traffic station according to claim 1, and further comprising a mobile radio device for receiving measurement data.

3. A central traffic station according to claim 1, and further comprising a transmitter for reading out at least one of traffic reports and traffic forecasts.

4. A central traffic station according to claim 1, and further comprising a transmitter interface for reading out at least one of traffic reports and traffic forecasts.

5. A process for completing and verifying data concerning a status of a traffic network in a central traffic station, comprising the steps of:

measuring measurement data about vehicles up to a present time;

calculating status data for at least a point in time prior to the present time concerning the status of the traffic network at this point in time;

calculating forecast data for a past time in the and concerning a future time with respect to the past time; and using the measured and calculated data to complete and verify the traffic network status data.

6. A process according to claim 5, including at least one of verifying and completing measurement data concerning at least a time in the past.

7. A process according to claim 5, including at least one of completing and verifying status data concerning the status of the traffic network at a time in the past.

8. A process according to claim 5, including calculating forecast data concerning a future status at a future point in time.

9. A process according to claim 5, including at least one of completing and verifying status data concerning the current status of the traffic network.

10. A process according to claim 9, including measuring the measurement data with at least one of stationary and mobile detectors.

11. A process according to claim 5, including filing statistical data concerning states in a historic database in the central traffic station and using at least one of the filed historic data and measurement data of the traffic network at times in the past.

12. A process according to claim 11, including storing at least one of profiles concerning time curves of measurement data and time curves of states in the historic database and using these data for completing and verifying at least one of measurement data and status data.

* * * * *